US011581627B2

(12) United States Patent
Yoo et al.

(10) Patent No.: US 11,581,627 B2
(45) Date of Patent: Feb. 14, 2023

(54) ELECTRONIC DEVICE INCLUDING SLOT ANTENNA MODULE

(71) Applicant: Samsung Electronics Co., Ltd., Gyeonggi-do (KR)

(72) Inventors: Jangsun Yoo, Gyeonggi-do (KR); Sunggeun Go, Gyeonggi-do (KR); Jihye Moon, Gyeonggi-do (KR); Myeonggil Lee, Gyeonggi-do (KR); Jongmyung Kim, Gyeonggi-do (KR); Cheehwan Yang, Gyeonggi-do (KR); Kwangyong Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 212 days.

(21) Appl. No.: 17/074,805

(22) Filed: Oct. 20, 2020

(65) Prior Publication Data

US 2021/0126345 A1 Apr. 29, 2021

(30) Foreign Application Priority Data

Oct. 28, 2019 (KR) ..... 10-2019-0134849

(51) Int. Cl.

| | |
|---|---|
| ***H01Q 1/24*** | (2006.01) |
| ***H01Q 13/10*** | (2006.01) |
| ***H01Q 1/38*** | (2006.01) |
| *H01Q 1/22* | (2006.01) |

(52) U.S. Cl.

CPC ..... *H01Q 1/243* (2013.01); *H01Q 1/38* (2013.01); *H01Q 13/10* (2013.01); *H01Q 1/2266* (2013.01)

(58) Field of Classification Search

CPC ..... H01Q 1/243; H01Q 1/38; H01Q 13/10; H01Q 1/2266; H01Q 1/242; H01Q 1/48; G06F 1/1698

See application file for complete search history.

(56) References Cited

U.S. PATENT DOCUMENTS

| | | | | |
|---|---|---|---|---|
| 2004/0051670 | A1* | 3/2004 | Sato | H01Q 13/10 343/702 |
| 2018/0254540 | A1 | 9/2018 | Yoo et al. | |
| 2018/0331418 | A1* | 11/2018 | Kim | H01Q 1/243 |

(Continued)

FOREIGN PATENT DOCUMENTS

| | | |
|---|---|---|
| CN | 102722220 A | 10/2012 |
| KR | 10-1898059 B1 | 10/2018 |

OTHER PUBLICATIONS

International Search Report dated Feb. 3, 2021.

*Primary Examiner* — David E Lotter

(74) *Attorney, Agent, or Firm* — Cha & Reiter, LLC

(57) ABSTRACT

In an embodiment, an electronic device may include a first cover covering an upper portion of a main body and containing a first antenna module disposed on a lateral portion thereof, a spacer member disposed over the first cover, and a second cover disposed over the spacer member. The first and second covers may be spaced apart from each other at a predetermined distance due to the spacer member, and a separation space between the first and second covers may be configured to operate as a second antenna module. It is therefore possible to guarantee high-efficiency wireless performance having iso-directionality without compromising the design of the electronic device. Other embodiments are also possible.

11 Claims, 11 Drawing Sheets

(56) References Cited

U.S. PATENT DOCUMENTS

| | | | | |
|---|---|---|---|---|
| 2018/0342791 | A1* | 11/2018 | Wu | H01Q 1/36 |
| 2018/0358686 | A1* | 12/2018 | Park | H01Q 1/2283 |
| 2019/0237847 | A1 | 8/2019 | Wu et al. | |

* cited by examiner

ELECTRONIC DEVICE INCLUDING SLOT ANTENNA MODULE

CROSS-REFERENCE TO RELATED APPLICATION(S)

This application is based on and claims priority under 35 U.S.C. 119 to Korean Patent Application No. 10-2019-0134849, filed on Oct. 28, 2019, in the Korean Intellectual Property Office, the disclosures of which are herein incorporated by reference in their entireties.

BACKGROUND

Field

The instant disclosure generally relates to an electronic device including at least one slot antenna module.

Description of Related Art

A great variety of portable electronic devices such as smart phones, notebook computers, and tablet PCs are becoming increasingly commonplace.

Conventionally, such portable electronic devices are capable of transmitting and receiving various kinds of data to and from other electronic devices through wireless communication.

In order to perform long-distance communication (e.g., voice call) and/or short-range communication (e.g., Bluetooth, Wi-Fi), the portable electronic device may include at least one antenna.

At the same time, these portable electronic devices are becoming thinner for improved portability. To maintain robustness the outer shell of the portable electronic devices may be made of metal housings.

In these portable electronic devices, at least a portion of the metal housings may be used as an antenna, and/or an antenna may be disposed in an inner space of the portable electronic devices.

In case where a portion of the metal housing is used as an antenna, the other portion of the metal housing may act as a radiation absorber. Unfortunately, this may degrade radiation efficiency and reduce bandwidth.

In case where an antenna is disposed inside the portable electronic device, the outer appearance of the electronic device may be disfigured because a portion of the outer housing may need to be made of plastic in order for signals to pass through to the antenna. In addition, due to noise caused by high-speed interface signals, signal reception performance may be deteriorated.

SUMMARY

According to an embodiment, an electronic device may include a metal housing and an antenna module. The metal housing may include a first portion covering an upper portion of a main body, a second portion covering a lateral portion of the main body, and a third portion covering a rear portion of the main body. The antenna module may include a slot formed in a part of the second portion, an antenna printed circuit board (PCB) disposed, at a position corresponding to the slot, near an inner surface of the second portion, and a fixing member configured to fix the antenna PCB. The slot and the antenna PCB may be configured to operate as an antenna.

According to an embodiment, an electronic device may include a first cover covering an upper portion of a main body and containing a first antenna module disposed on a lateral portion thereof, a spacer member disposed over the first cover, and a second cover disposed over the spacer member. The first and second covers may be spaced apart from each other at a predetermined distance due to the spacer member, and a separation space between the first and second covers may be configured to operate as a second antenna module.

Additional aspects will be set forth in part in the description which follows and, in part, will be apparent from the description, or may be learned by practice of the presented embodiments.

BRIEF DESCRIPTION OF THE DRAWINGS

The above and other aspects, features and advantages of certain embodiments of the disclosure will be more apparent from the following detailed description, taken in conjunction with the accompanying drawings.

DETAILED DESCRIPTION

One or more embodiments of the instant disclosure may provide an electronic device including a slot antenna module capable of guaranteeing high-efficiency wireless performance having iso-directionality without compromising the outer appearance design of the electronic device.

Hereinafter, various example embodiments of the disclosure will be described in greater detail with reference to accompanying drawings.

Figure 1:
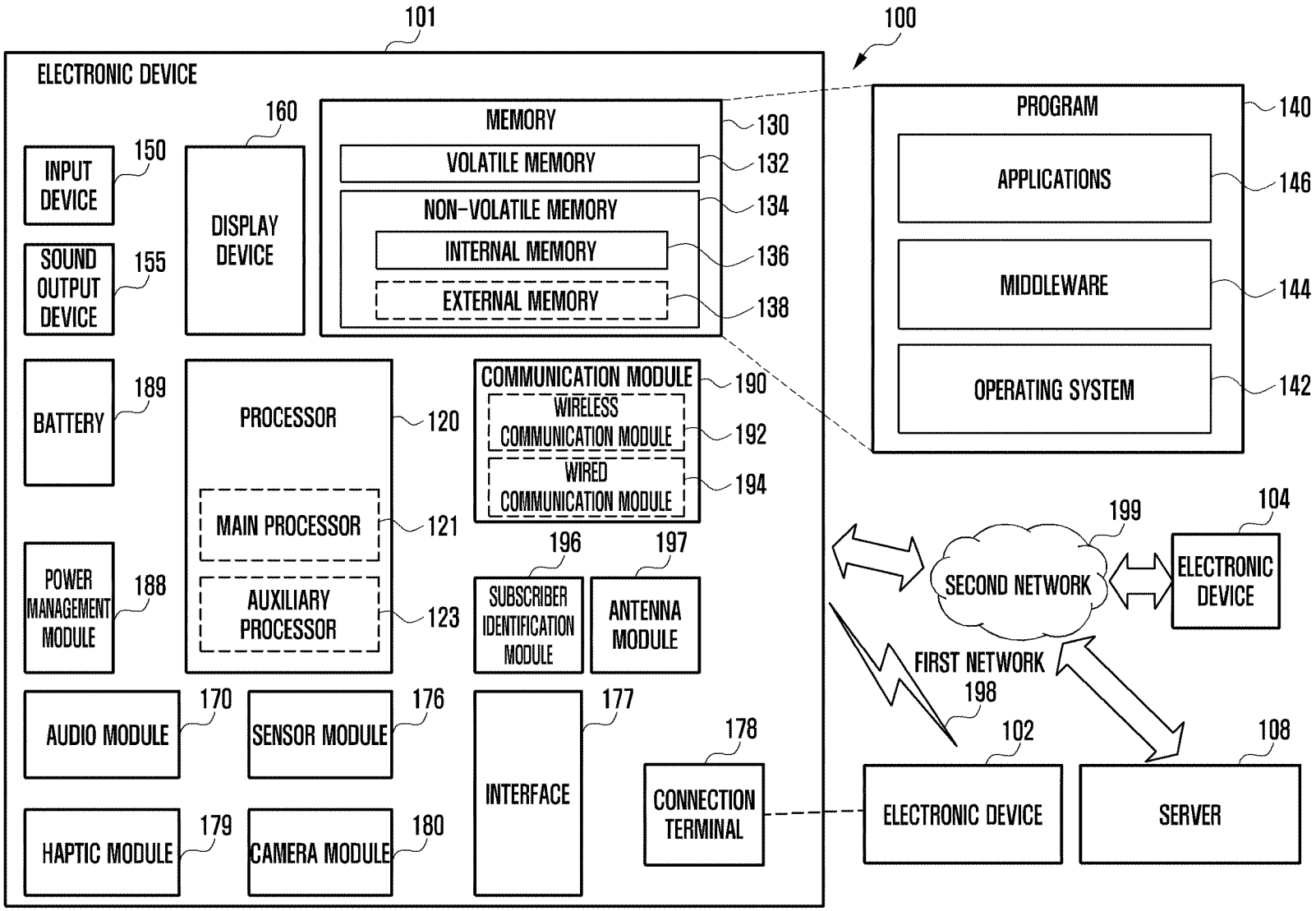
FIG. 1 is a block diagram illustrating an electronic device in a network environment according to various embodiments of the disclosure.

FIG. 1 is a block diagram illustrating an electronic device 101 in a network environment 100 according to certain embodiments.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform certain data processing or computation. According to an embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store certain data used by at least one component (e.g., the processor 120 or the sensor module 176) of the electronic device 101. The certain data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to an embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These certain types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit/receive a signal or power to/from an external entity (e.g., an external electronic device). According to some embodiments, the antenna module 197 may be formed of a conductor or a conductive pattern and may further include any other component (e.g., RFIC). According to an embodiment, the antenna module 197 may include one or more antennas, which may be selected to be suitable for a communication scheme used in a specific communication network, such as the first network 198 or the second network 199 by, for example, the communication module 190. Through the selected at least one antenna, a signal or power may be transmitted or received between the communication module 190 and the external electronic device.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

The electronic device according to certain embodiments may be one of certain types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include certain changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

Figure 2:
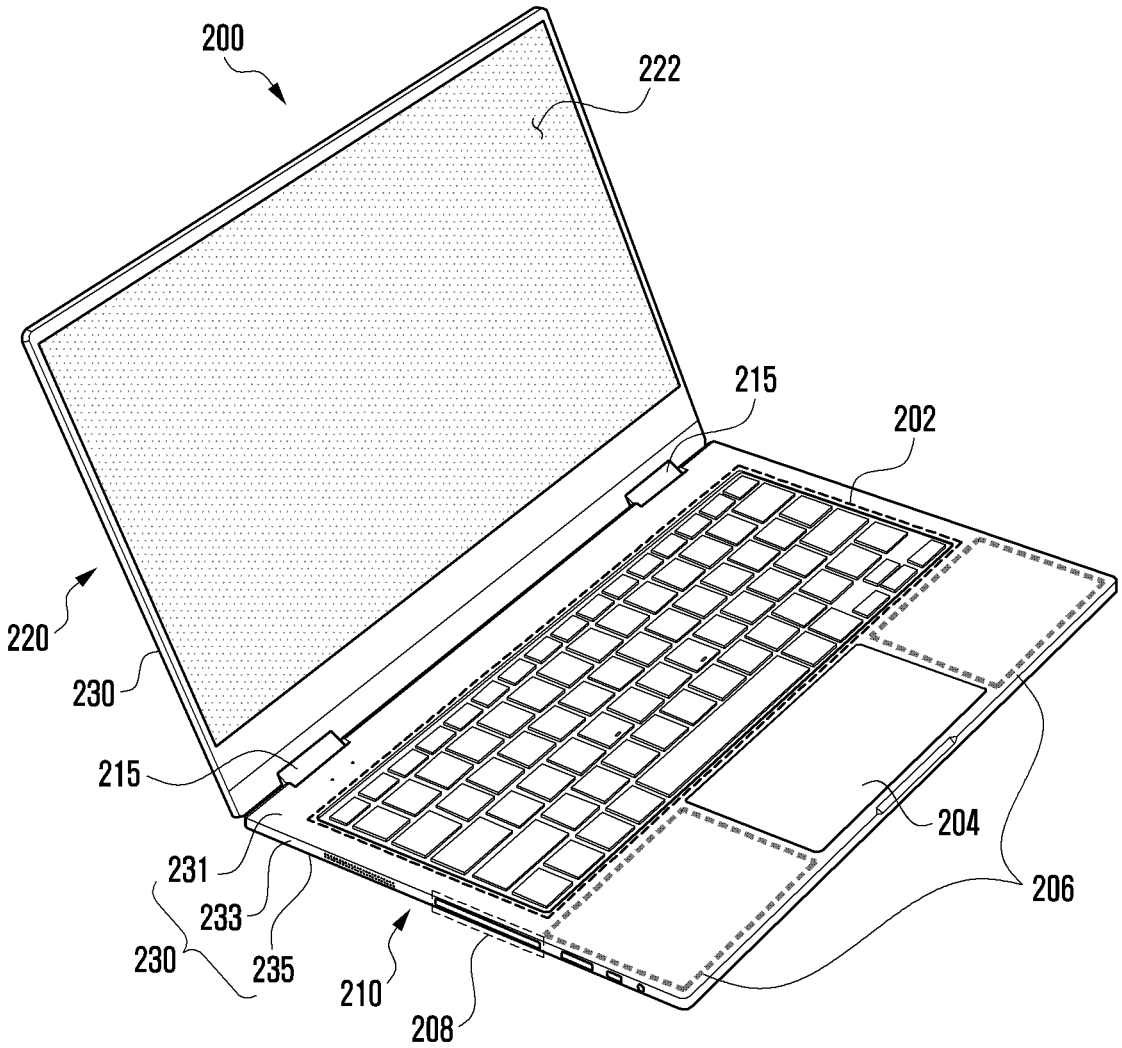
FIG. 2 is a perspective view illustrating an electronic device according to an embodiment of the disclosure.

FIG. 2 is a perspective view illustrating an electronic device according to an embodiment of the disclosure.

Referring to FIG. 2, the electronic device 200 according to an embodiment may include a main body 210, a connector 215, a display body 220, and a metal housing 230.

According to an embodiment, the electronic device 200 may be the electronic device 101 shown in FIG. 1. For example, as shown in the figure, the electronic device 200 may be a notebook computer. However, the instant disclosure is not so limited, and the electronic device 200 may alternatively be a smart phone, a tablet PC, an e-book terminal, a portable multimedia device, a portable medical device, a wearable device, or a home appliance.

According to an embodiment, the main body 210 may include a keyboard 202, a touch pad 204, a palm rest 206, and an antenna module 208.

According to an embodiment, the keyboard 202 (e.g., the input device 150 in FIG. 1) may be configured to have a plurality of keys arranged in an upper portion of the main body 210. The keyboard 202 may receive user inputs for entering numeric or character data. The keyboard 202 may include a plurality of alphanumeric input keys and a plurality of function keys. The function keys may include navigation keys, volume keys, and various shortcut keys each configured to perform a particular function. The keyboard 203 may be implemented as a QWERTY key array, a 3*4 key array, a 4*3 key array, or any other alternative key array.

According to an embodiment, the touch pad 204 may implement the functionalities of a mouse. For example, the touch pad 204 may receive a user's touch input for selecting or executing an application displayed on the screen 222 of the display body 220.

According to an embodiment, the palm rest 206 may support user's palms and wrists when the user of the electronic device 200 uses the keyboard 202.

According to an embodiment, the antenna module 208 (e.g., the antenna module 197 in FIG. 1) may transmit and receive signals or power to and from an external electronic device (e.g., the electronic devices 102, 104, and 108 in FIG. 1). The antenna module 208 will be described below with reference to FIG. 3.

According to an embodiment, the connector 215 may connect the main body 210 and the display body 220, and do so in a way so that the main body 210 and the display body 220 can be folded or unfolded with respect to each other. The connector 215 may mechanically connect the main body 210 and the display body 220. In this case, the connector 215 may include a hinge member at a certain position. In addition, the connector 215 may electrically connect the main body 210 and the display body 220. In this case, the connector 215 may include a flexible printed circuit board (FPCB) at a certain position.

According to an embodiment, the display body 220 may include the screen 222. The screen 222 may include the display device 160 in FIG. 1.

According to an embodiment, the screen 222 may display various content of the electronic device 200, data inputted by the user through the keyboard 202, and/or information to be visually provided to the user. The screen 222 may be a liquid crystal display (LCD), an organic light emitting diode (OLED) display, an active matrix OLED (AMOLED) display, a flexible display, or a transparent display. The screen 222 may visually display thereon various screens associated with the use of the portable electronic device 200, for example, a home screen, a menu screen, a lock screen, a game screen, a web page screen, a call screen, a music or video playback screen, and the like.

According to an embodiment, the metal housing 230 may form the outer chassis of the main body 210. The metal housing 230 may also be applied to the palm rest 206 of the main body 210. The metal housing 230 may protect various electronic components (e.g., the processor 120, the memory 130, the sensor module 176, and the like in FIG. 1) contained in the main body 210. The metal housing 230 may have a first portion 231 covering an upper portion of the main body 210, a second portion 233 covering a lateral portion of the main body 210, and a third portion 235 covering a rear or bottom portion of the main body 210.

According to an embodiment, the metal housing 230 may also form the outer chassis of the display body 220. The metal housing 230 may protect various electronic components (e.g., the camera module 180, the sound output device 155, and the like in FIG. 1) contained in the display body 220.

Figure 3:
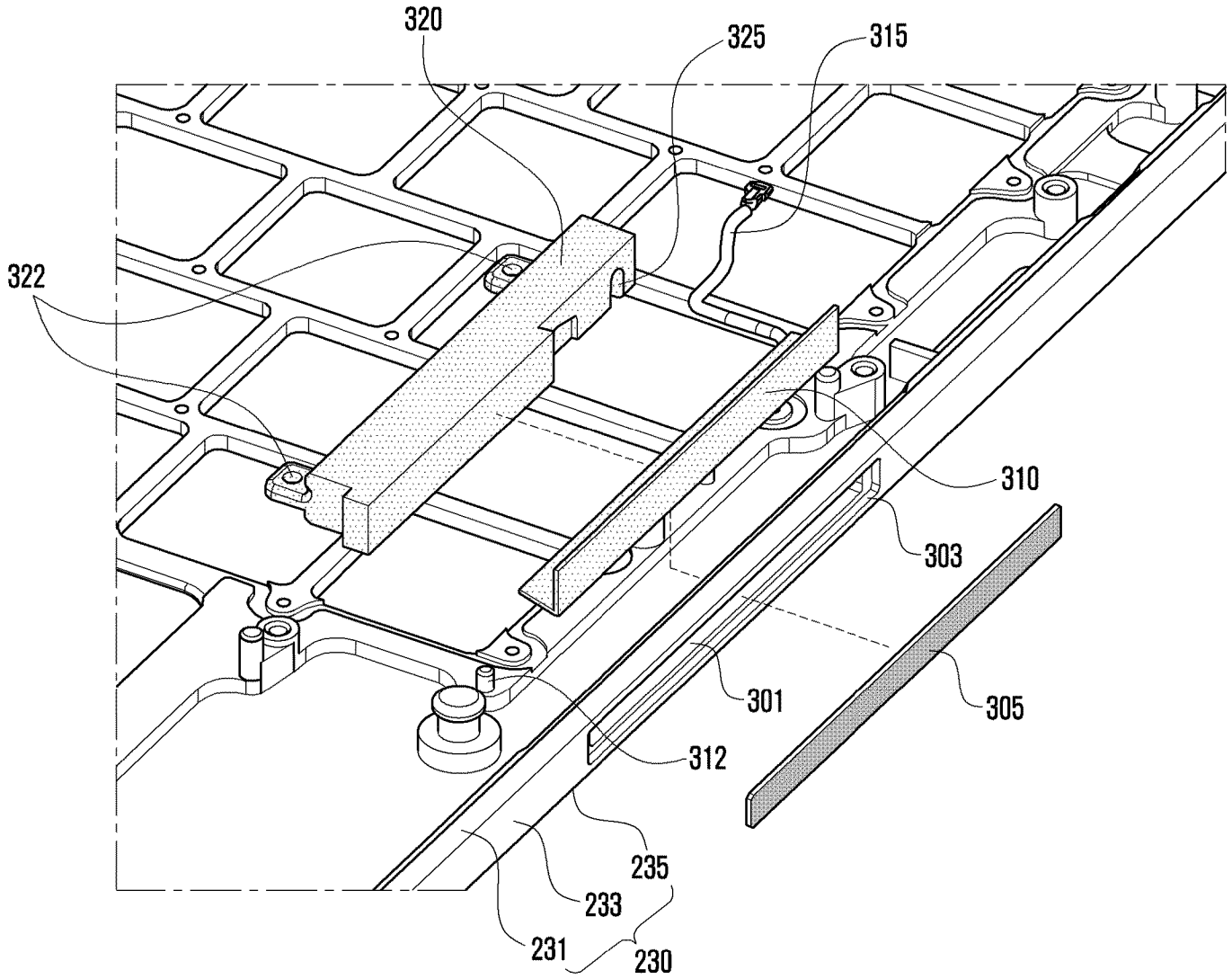
FIG. 3 is an exploded perspective view illustrating an antenna module according to an embodiment of the disclosure.

FIG. 3 is an exploded perspective view illustrating an antenna module according to an embodiment of the disclosure. FIG. 3 is an enlarged view showing an example of the antenna module 208 shown in FIG. 2 (e.g., the antenna module 197 in FIG. 1) and its periphery. The antenna module shown in FIG. 3 may be referred to as a first antenna module in the disclosure.

Referring to FIG. 3, the antenna module 208 according to an embodiment may include a slot 301, a plate 305, an antenna PCB 310, and a fixing member 320.

According to an embodiment, the slot 301 may be formed partially in the second portion 233 (e.g., the lateral portion) of the metal housing 230. Again, the metal housing 230 may form the outer chassis of the main body 210.

According to an embodiment, the slot 301 may have the shape of a narrow and elongated hole. The slot 301 may be changed in size according to the antenna frequency required by the electronic device 200. The slot 301 may be formed to minimize damage to the metal housing 230. The slot 301 may have a stepped portion 303 formed along an edge of the slot 301.

According to an embodiment, the plate 305 may cover the slot 301. That is, the plate 305 may be mounted on and engaged with the stepped portion 303 to close the slot 301.

According to an embodiment, the plate 305 may be engaged with the stepped portion 303 via an adhesive, a hook, and/or by double injection. The plate 305 may be made of polycarbonate (PC) or acrylonitrile butadiene styrene (ABS) resin. Alternatively, the plate 305 may be made of a metallic material having a resistance value of about 1 giga-ohm to about 20 giga-ohms.

According to an embodiment, the antenna PCB 310 may be disposed close to the slot 301. Specifically, the antenna PCB 310 may be disposed, at a position corresponding to the slot 301, near the inner surface of the second portion 233 (e.g., the lateral portion) of the metal housing 230.

According to an embodiment, the antenna PCB 310 may be coupled to the slot 301, thus operating the slot 301 as an antenna. The antenna PCB 310 may include a power feeder and an antenna pattern to operate the slot 301 as an antenna. The antenna PCB 310 may also include an electric cable 315. The cable 315 may be connected to a communication module (e.g., the communication module 190 in FIG. 1) of the electronic device. At least one engaging protrusion 312 may be disposed around the antenna PCB 310 in the main body 210.

According to an embodiment, the fixing member 320 may be fixed to the antenna PCB 310 on a first side or front side thereof. The fixing member 320 may accurately fix the antenna PCB 310 to the position corresponding to the slot 301. The fixing member 320 may allow the slot 301 and the antenna PCB 310 to maintain a predetermined distance. The fixing member 320, having a fixed distance from the antenna PCB 310, may contribute to ensuring uniform radiation performance of the antenna module. The fixing member 320 may be attached to the inner surface of the third portion 235 of the metal housing 230 via an adhesive member (not shown) such as double-sided adhesive tape. The double-sided adhesive tape may be made of a conductive material.

According to an embodiment, the fixing member 320 may have a receiving hole 325 for accommodating and fixing the cable 315 connected to the antenna PCB 310. The fixing member 320 may also have at least one engaging hole 322 on a second side or rear side thereof. The engaging hole(s) 322 may be engaged with the engaging protrusion(s) 312 disposed around the antenna PCB 310, so that the antenna PCB 310 may be spaced apart from the slot 301 at a predetermined distance.

According to an embodiment, instead of the engaging protrusion 312, a screw may be used to be engaged with the engaging hole 322. The screw may be made of a non-conductive material. If the screw is made of a conductive material, the screw should be spaced apart from the slot 301 at a given distance or more so as not to deteriorate the radiation performance of the antenna module.

Figure 4:
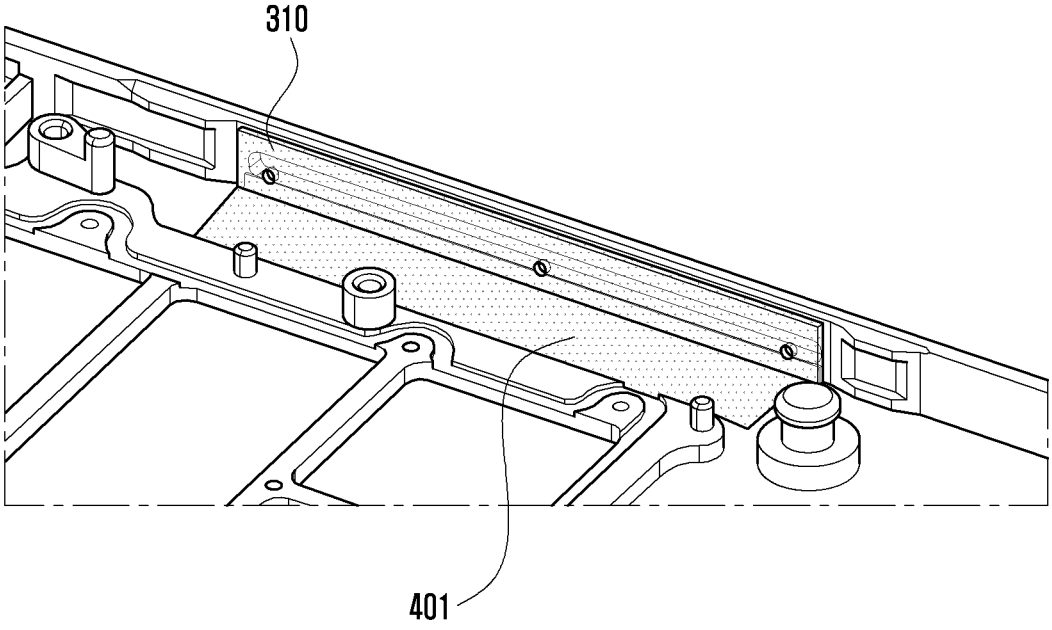
FIG. 4 is a perspective view illustrating an antenna PCB of an antenna module according to an embodiment of the disclosure.

FIG. 4 is a perspective view illustrating an antenna PCB of an antenna module according to an embodiment of the disclosure.

Referring to FIG. 4, the antenna module 208 according to an embodiment may include a ground layer 401 formed integrally with and extended from a lower portion of the antenna PCB 310.

According to an embodiment, the ground layer 401 may be disposed on the inner surface of the third portion 235 of the metal housing 230. In order to ensure the performance of the antenna PCB 310, the ground layer 401 may be disposed on a surface perpendicular to the antenna PCB 310.

According to an embodiment, the ground layer 401 may be omitted depending on the design of the electronic device 200 and the antenna module 208.

Figure 5:
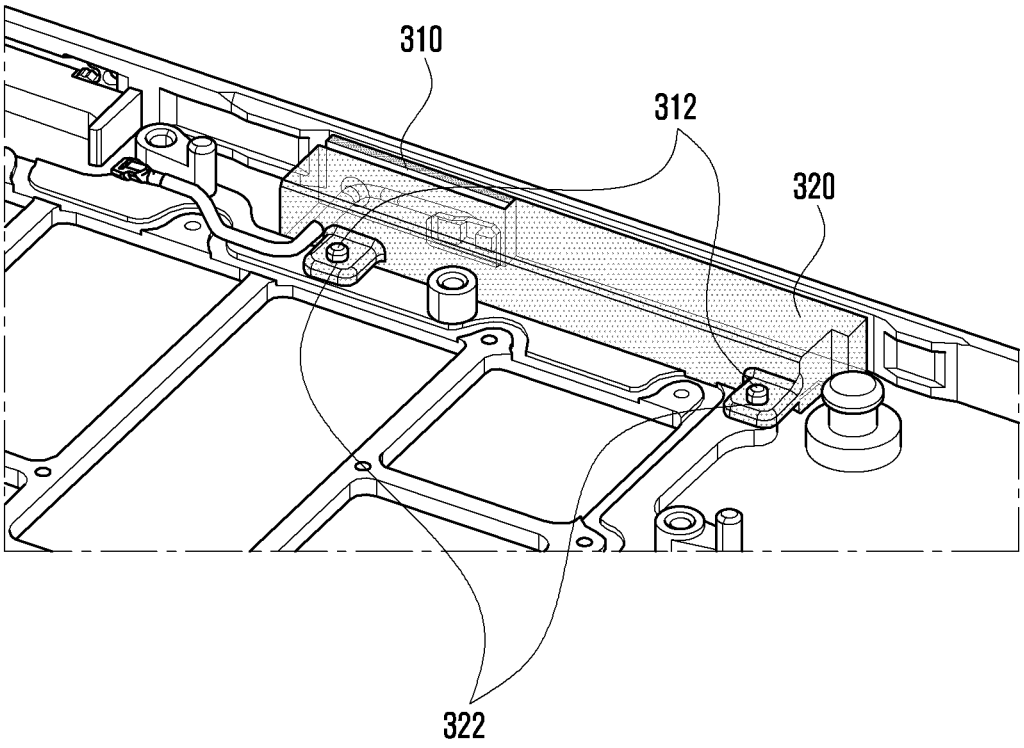
FIG. 5 is a perspective view illustrating an arrangement structure of an antenna module according to an embodiment of the disclosure.

FIG. 5 is a perspective view illustrating an arrangement structure of an antenna module according to an embodiment of the disclosure.

Referring to FIG. 5, in the antenna module 208 according to an embodiment, the fixing member 320 may be fixed to the antenna PCB 310.

According to an embodiment, the fixing member 320 may accurately fix the antenna PCB 310 to the position corresponding to the slot 301. In addition, the fixing member 320 may fix the antenna PCB 310 so that it is a predetermined distance away from the slot 301. The fixing member 320 may be stably disposed because the engaging hole(s) 322 may be engaged with the engaging protrusion(s) 312 disposed around the antenna PCB 310. Also, the fixing member 320 may be further stably disposed because it may be attached to the inner surface of the third portion 235 of the metal housing 230 via an adhesive member such as a double-sided adhesive tape.

Figure 6:
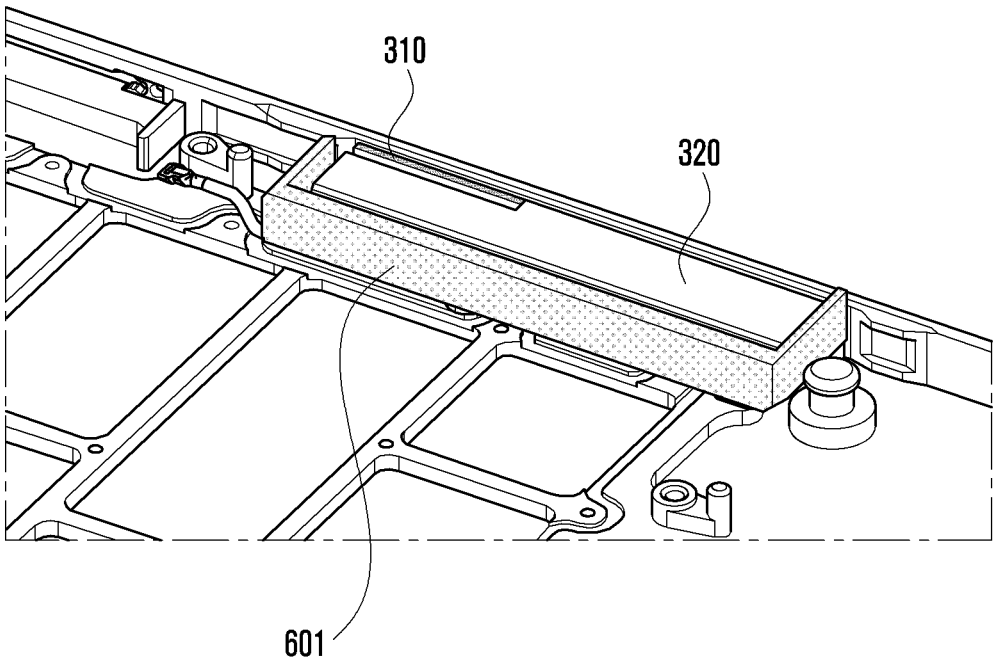
FIG. 6 is a perspective view illustrating an arrangement structure of an antenna module according to another embodiment of the disclosure.

FIG. 6 is a perspective view illustrating an arrangement structure of an antenna module according to another embodiment of the disclosure.

Referring to FIG. 6, the antenna module 208 according to another embodiment may include a wall portion 601 surrounding at least a part of the fixing member 320.

According to an embodiment, the wall portion 601 may surround three sides of the fixing member 320. That is, the wall portion 601 may surround the fixing member 320 except for the side of the fixing member 320 that is facing the inner surface of the second portion 233 of the metal housing 230. The wall portion 601 may be made of a metallic material.

According to an embodiment, the wall portion 601 may prevent current flowing through the antenna PCB 310 from affecting other components disposed in the inner space of the electronic device 200. The wall portion 601 may also assist to guide the radiation of the antenna module toward the slot 301. Thus, the wall portion 601 may also perform the function of shielding electrical noise.

Figure 7:
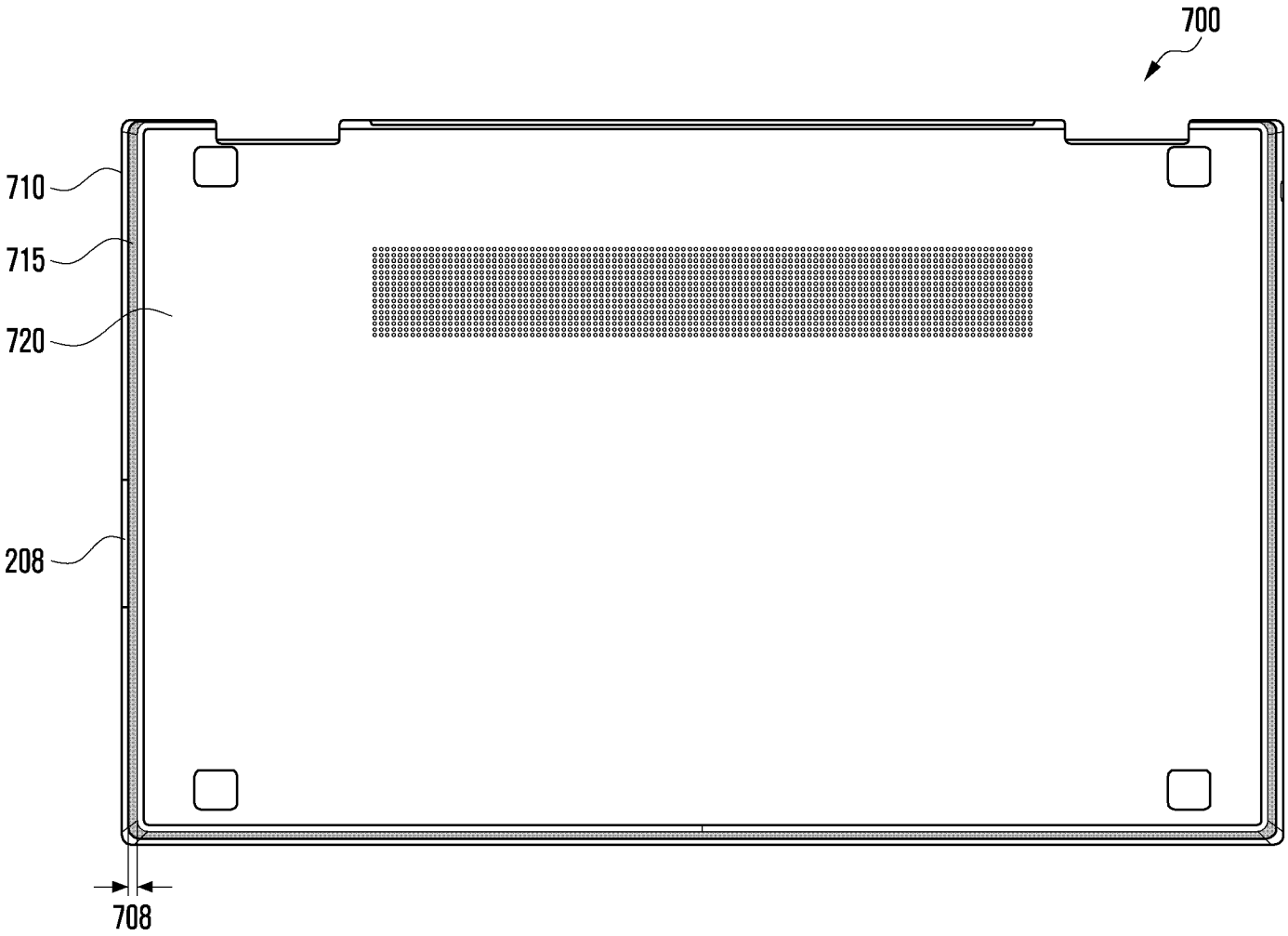
FIG. 7 is a plan view illustrating a rear surface of an electronic device including at least one antenna module according to an embodiment of the disclosure.
Figure 8:
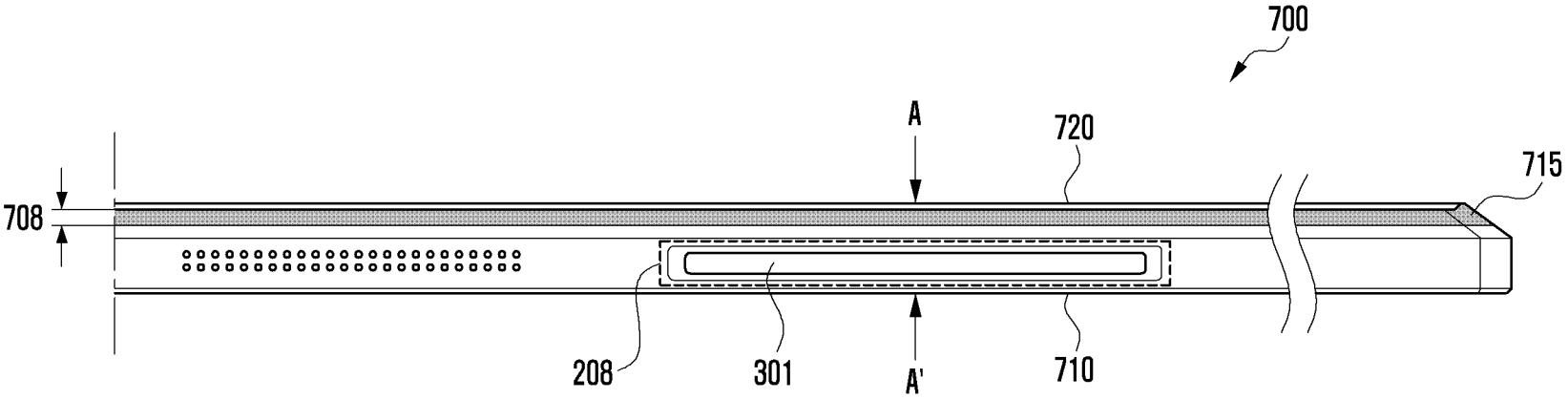
FIG. 8 is a side view illustrating a lateral portion of a main body of an electronic device including at least one antenna module according to an embodiment of the disclosure.
Figure 9:
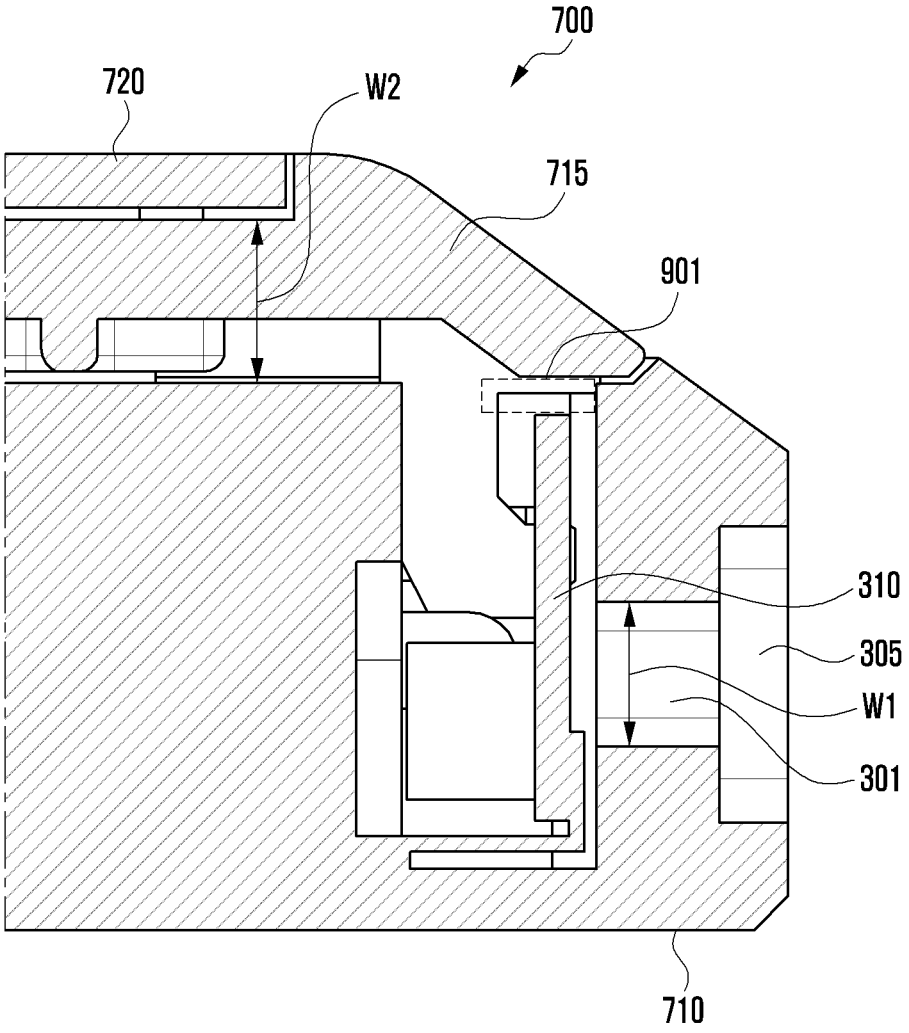
FIG. 9 is a cross-sectional view illustrating a lateral portion of a main body of an electronic device including at least one antenna module according to an embodiment of the disclosure.

FIG. 7 is a plan view illustrating a rear surface of an electronic device including at least one antenna module according to an embodiment of the disclosure. FIG. 8 is a side view illustrating a lateral portion of a main body of an electronic device including at least one antenna module according to an embodiment of the disclosure. FIG. 9 is a cross-sectional view illustrating a lateral portion of a main body of an electronic device including at least one antenna module according to an embodiment of the disclosure. For example, FIG. 9 may be a cross-sectional view taken along the line A-A' of FIG. 8.

The electronic device 700 shown in FIGS. 7 to 9 may include the above-described antenna module 208 shown in FIGS. 2 to 6. In the following description of FIGS. 7 to 9, duplicative descriptions about the same elements and functions as those of the above-described embodiments of FIGS. 2 to 6 may be omitted.

In the description of FIGS. 7 to 9, the above-described antenna module 208 shown in FIGS. 2 to 6 may be referred to as a first antenna module 208.

Referring to FIGS. 7 to 9, the electronic device 700 according to an embodiment may include a first cover 710, a spacer member 715, and a second cover 720.

According to an embodiment, the electronic device 700 may be the electronic device 101 in FIG. 1 and/or the electronic device 200 in FIG. 2.

According to an embodiment, the first cover 710 may cover an upper portion of a main body, for example, the upper portion of the main body 210 where the keyboard 202, the touch pad 204, and the palm rest 206 are disposed as shown in FIG. 2. The first cover 710 may be made of a metallic material. The first cover 710 may be at least a part of the above-described metal housing 230.

According to an embodiment, the first antenna module 208 may be disposed on a lateral portion of the first cover 710. The antenna PCB 310 of the first antenna module 208 may disposed vertically in or with the first cover 710. As shown in FIG. 9, an area 901 having no metallic material may exist above the antenna PCB 310. The first antenna module 208 may perform primary radiation to the outside of the electronic device 700.

According to an embodiment, the spacer member 715 may be disposed over the first cover 710. The spacer member 715 may be configured to allow the first and second covers 710 and 720 to be spaced apart from each other at a certain distance. The spacer member 715 may be made of a non-conductive material (e.g., plastic).

According to an embodiment, the spacer member 715 may be disposed between the first cover 710 and the second cover 720. Thus, the first cover 710 and the second cover 720, due to the spacer member 715, may be electrically floating with respect to each other. The separation space between the first cover 710 and the second cover 720 may operate as a second antenna module 708. The second antenna module 708 may be coupled to the antenna PCB 310, thus operating as an antenna. That is, when a flow of current is generated between the first cover 710 and the second cover 720, the second antenna module 708 may perform secondary radiation to the outside.

According to an embodiment, the width W2 of the separation space between the first cover 710 and the second cover 720 (i.e., the width of the second antenna module 708) may be greater than the width W1 of the slot 301 of the first antenna module 208.

According to an embodiment, the second cover 720 may be disposed on the spacer member 715. The second cover 720 may cover a lower portion of the main body 210 as shown in FIG. 2. The second cover 720 may be made of a metallic material. The second cover 720 may be at least a part of the above-described metal housing 230.

According to an embodiment, because the first and second covers 710 and 720 are electrically floating state with respect to each other due to the spacer member 715 as mentioned above, the four sides of the electronic device 700 may not be connected. However, the space between the first and second covers 710 and 720 operates as the second antenna module 708, so that radiation can be made on all four sides of the electronic device 700.

Figure 10:
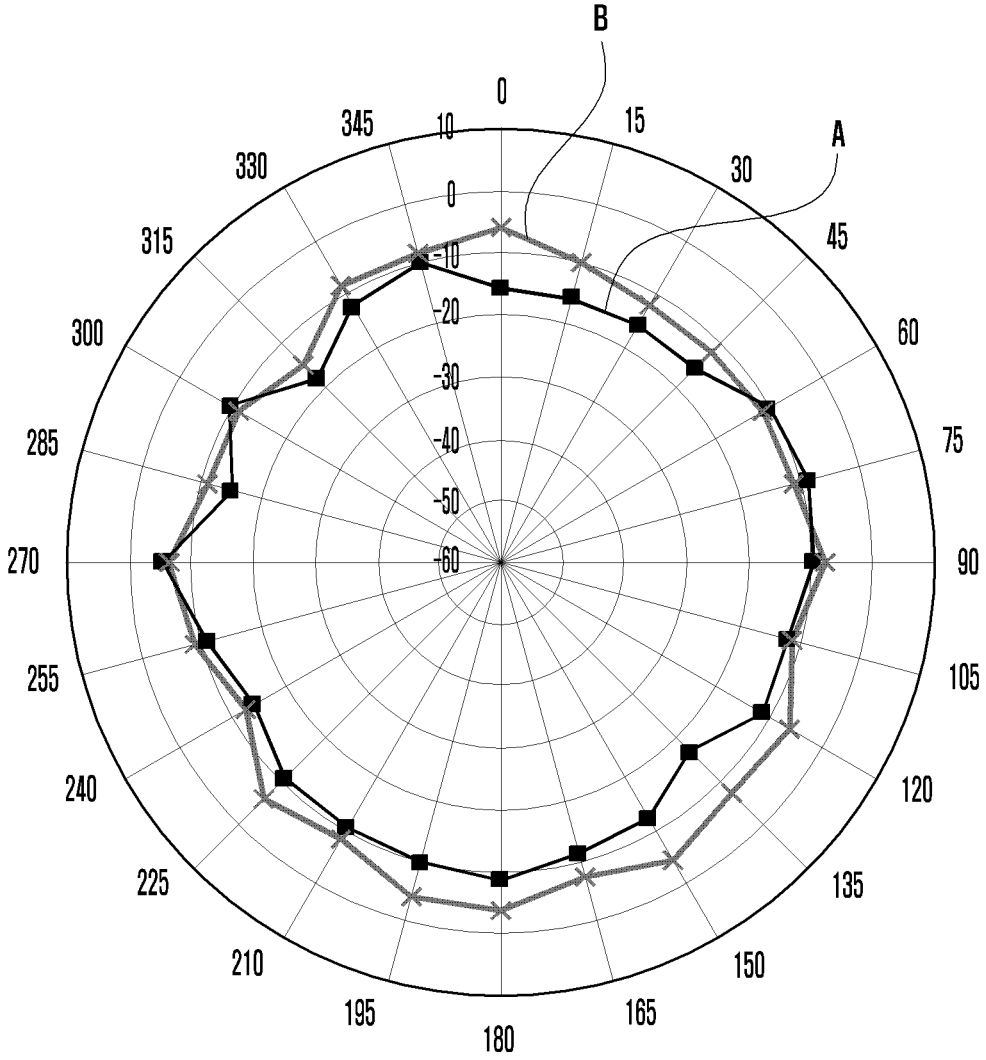
FIG. 10 is a diagram comparing radiation characteristics of an electronic device according to an embodiment of the disclosure with those of a conventional electronic device.

FIG. 10 is a diagram comparing radiation characteristics of an electronic device according to an embodiment of the disclosure with those of a conventional electronic device.

Specifically, FIG. 10 shows radiation characteristics (B) of the electronic device 700 of an embodiment of the disclosure and radiation characteristics (A) of a conventional electronic device, measured in the 2.4 GHz and 5 GHz WLAN frequency bands.

Referring to FIG. 10, it can be seen that the electronic device 700 shown in FIGS. 7 to 9 has iso-directionality compared to the conventional electronic device (e.g., a metal housing parting). That is, it can be seen that the electronic device 700 according to an embodiment has excellent directionality compared to the conventional electronic device.

Figure 11:
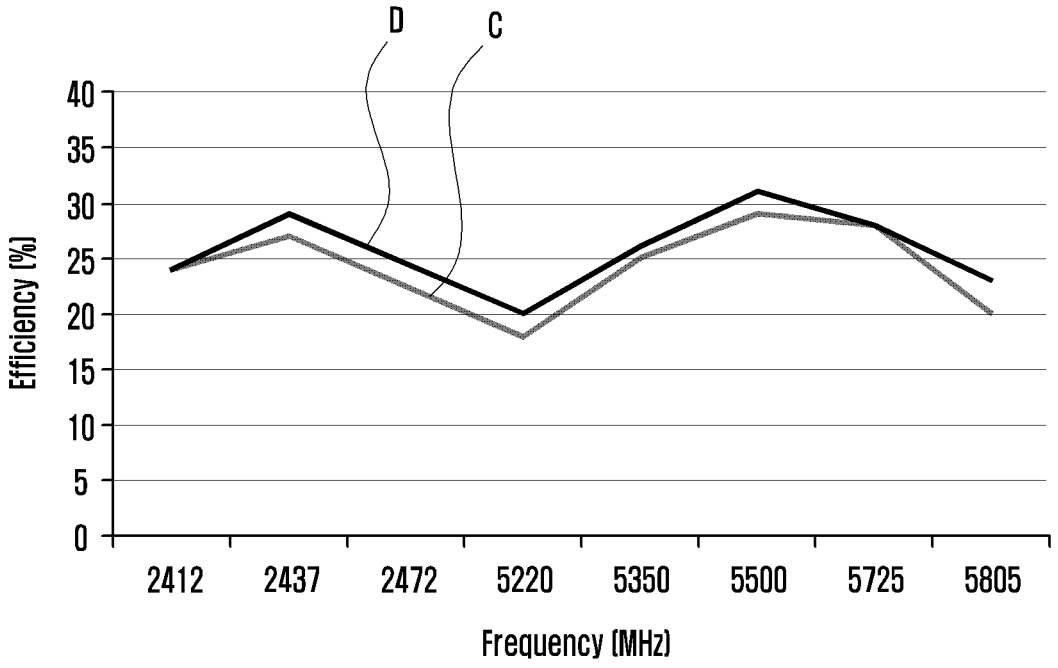
FIG. 11 is a diagram comparing antenna performance between an electronic device according to an embodiment of the disclosure and a conventional electronic device.

FIG. 11 is a diagram comparing antenna performance between an electronic device according to an embodiment of the disclosure and a conventional electronic device.

Specifically, FIG. 10 shows antenna performance (D) of the electronic device 700 of an embodiment of the disclosure and antenna performance (C) of the conventional electronic device, measured in the 2.4 GHz and 5 GHz WLAN frequency bands.

Referring to FIG. 11, it can be seen that the electronic device 700 shown in FIGS. 7 to 9 has excellent antenna performance compared to the conventional electronic device (e.g., a metal housing parting).

While the disclosure has been particularly shown and described with reference to exemplary embodiments thereof, it will be understood by those skilled in the art that various changes in form and details may be made therein without departing from the scope of the subject matter as defined by the appended claims.

What is claimed is:

1. An electronic device comprising:

a first cover covering an upper portion of a main body and containing a first antenna module disposed on a lateral portion thereof;

a spacer member disposed over the first cover; and a second cover disposed over the spacer member, wherein the first and second covers are spaced apart from each other at a predetermined distance due to the spacer member, and wherein a separation space between the first and second covers is configured to operate as a second antenna module.

2. The electronic device of claim 1, wherein each of the first and second covers is made of a metallic material, and the spacer member is made of a non-conductive material.

3. The electronic device of claim 1, wherein the first antenna module includes:

a slot formed in a part of the lateral portion of the first cover;

an antenna printed circuit board (PCB) disposed, at a position corresponding to the slot, near an inner surface of the lateral portion; and a fixing member configured to fix the antenna PCB.

4. The electronic device of claim 3, wherein the antenna PCB of the first antenna module is disposed vertically with respect to the first cover.

5. The electronic device of claim 4, further comprising an area having no metallic material disposed above the antenna PCB.

6. The electronic device of claim 3, wherein a width of the separation space between the first and second covers is greater than a width of the slot.

7. The electronic device of claim 3, wherein the slot has a stepped portion formed along an edge of the slot, and a plate is mounted on and engaged with the stepped portion to close the slot.

8. The electronic device of claim 3, wherein the antenna PCB includes a power feeder and an antenna pattern to operate the slot as an antenna.

9. The electronic device of claim 3, wherein the fixing member has at least one engaging hole engaged with at least one engaging protrusion disposed around the antenna PCB.

10. The electronic device of claim 3, wherein a ground layer is formed integrally with and extended from a lower portion of the antenna PCB to be perpendicular to the antenna PCB.

11. The electronic device of claim 3, wherein the first antenna module further comprises a wall portion surrounding at least a part of the fixing member.

* * * * *